US008224214B2

(12) United States Patent
Durham et al.

(10) Patent No.: US 8,224,214 B2
(45) Date of Patent: Jul. 17, 2012

(54) COLLAPSIBLE PACKAGING SYSTEM

(75) Inventors: Michele Kayla Mae Durham, Tualatin, OR (US); Robert C. Tidrick, Tigard, OR (US); Heinz Erwin Grellmann, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 112 days.

(21) Appl. No.: 12/497,053

(22) Filed: Jul. 2, 2009

(65) Prior Publication Data

US 2009/0260210 A1 Oct. 22, 2009

Related U.S. Application Data

(62) Division of application No. 11/316,727, filed on Dec. 23, 2005, now Pat. No. 7,577,384.

(51) Int. Cl.
*G03G 15/08* (2006.01)
*B41J 2/17* (2006.01)
*B41J 2/175* (2006.01)

(52) U.S. Cl. ..... 399/258; 347/84; 347/85

(58) Field of Classification Search ..... 347/258, 347/84, 85; 399/258
See application file for complete search history.

(56) References Cited

U.S. PATENT DOCUMENTS

| | | | | |
|---|---|---|---|---|
| 4,714,937 | A * | 12/1987 | Kaplinsky | 347/86 |
| 5,075,727 | A * | 12/1991 | Nakatomi | 399/103 |
| 5,307,091 | A * | 4/1994 | DeCoste, Jr. | 347/86 |
| 6,217,165 | B1 * | 4/2001 | Silverbrook | 347/86 |
| 7,058,343 | B1 * | 6/2006 | Biegelsen | 399/258 |
| 2005/0243148 | A1 * | 11/2005 | Miyazawa et al. | 347/86 |

FOREIGN PATENT DOCUMENTS

JP 04246545 A * 9/1992

* cited by examiner

*Primary Examiner* — Stephen Meier
*Assistant Examiner* — Sarah Al Hashimi
(74) *Attorney, Agent, or Firm* — Wiggin and Dana LLP

(57) ABSTRACT

A package suitable for containing marking material used in a printing machine. The package includes a package surface adapted to engage one or more surfaces of the printing machine and a material identifier mechanism for verifying the marking material. The package may also include a material pouch, which is adapted to contain the marking material, joined with or formed in the package surface. Alternatively, the package may include a carrier adapted to engage one or more surfaces of the printing machine and a material pouch joined with the carrier. Other aspects include a method of remanufacturing a package suitable for containing marking material used in a printing machine.

8 Claims, 6 Drawing Sheets

COLLAPSIBLE PACKAGING SYSTEM

CROSS-REFERENCE TO RELATED APPLICATIONS

This is a divisional application of application Ser. No. 11/316,727, filed Dec. 23, 2005.

BACKGROUND

A common trend in machine design is to organize a machine on a modular basis, wherein certain distinct subsystems of the machine are bundled together into modules, which can be readily removed from the machine and replaced with new modules of the same or similar type. A modular design facilitates great flexibility in the business relationship with the customer. By providing subsystems in discrete modules, visits from a service representative can be made very short, since all the representative has to do is remove and replace a defective module. Actual repair of the module may take place remotely at the service provider's premises. As another alternative, some modules lend themselves to replacement by the customers themselves, and these are often referred to as "customer replaceable unit monitors" or "CRUMS." Further, some customers may wish to have the ability to buy modules "off the shelf," such as from an equipment supply store. Indeed, it is possible that a customer may lease the machine and wish to buy a supply of modules as needed. Further, the use of modules, particularly for expendable supply units (e.g., copier and printer toner bottles) are conducive to recycling activities. In addition, modules may be used for anti-theft or security purposes, for example, where the module may be removed by the user to disable the machine (e.g., face plates on automobile radios and wireless network cards installed in laptop computers).

For machines that require replenishment of materials on a regular basis, a modular design may be particularly useful. Materials may be pre-packaged in a manner that makes them easily introduced to a relevant module. Unfortunately, for some types of materials, e.g., toner, ink, and other printing materials, oftentimes current modular designs fail to solve the unwanted problems of material spills and difficult to dispose of expended material packaging.

BRIEF SUMMARY

According to one aspect, there is provided a package suitable for containing marking material used in a printing machine. The package includes a package surface adapted to engage one or more surfaces of the printing machine and material identifier means for verifying the marking material.

According to another aspect, there is provided a package suitable for containing marking material used in a printing machine. The package includes a material pouch adapted to engage one or more surfaces of the printing machine and material identifier means for verifying the contents of the material pouch.

According to another aspect, there is provided a collapsible package suitable for containing solid or particulate marking material used in a printing machine. The package includes a material pouch adapted to engage one or more surfaces of the printing machine. The material pouch includes a burst line and is adapted to contain solid or particulate marking material.

According to still another aspect, there is provided a package suitable for containing marking material used in a printing machine. The package includes a carrier adapted to engage one or more surfaces of the printing machine, a material pouch joined with the carrier, and material identifier means for verifying the contents of the material pouch.

According to yet another aspect, there is provided a method of remanufacturing a package suitable for containing marking material used in a printing machine. The method includes the following steps: providing an at least partially empty material pouch that is adapted to engage one or more surfaces of the printing machine, the material pouch including an unsealed burst line and an information-bearing tag for verifying the contents of the material pouch; at least partially filling the material pouch with marking material; and sealing the burst line.

According to another aspect, there is provided a method of remanufacturing a package suitable for containing marking material used in a printing machine. The method includes the following steps: providing an at least partially empty material pouch including an information-bearing tag for verifying the contents of the material pouch; removing the information-bearing tag from the at least partially empty material pouch; providing a replacement material pouch that is substantially full of marking material; and attaching the information-bearing tag to the replacement material pouch.

According to still another aspect, there is provided a method of remanufacturing a package suitable for containing marking material used in a printing machine. The method includes the following steps: providing a carrier adapted to engage one or more surfaces of the printing machine; and joining a material pouch, which contains marking material, with the carrier.

According to yet another aspect, there is provided a method of remanufacturing a package suitable for containing particulate solid ink used in a printing machine. The method includes the following steps: providing a material pouch that is at least partially empty of particulate solid ink, the material pouch including an unsealed burst line and an information-bearing tag for verifying the contents of the material pouch; at least partially filling the material pouch with particulate solid ink; sealing the burst line; providing a carrier adapted to engage one or more surfaces of the printing machine; and joining the material pouch with the carrier.

BRIEF DESCRIPTION OF THE DRAWING

Referring now to the figures, which are exemplary embodiments, wherein like items are numbered alike.

DETAILED DESCRIPTION

Figure 1:
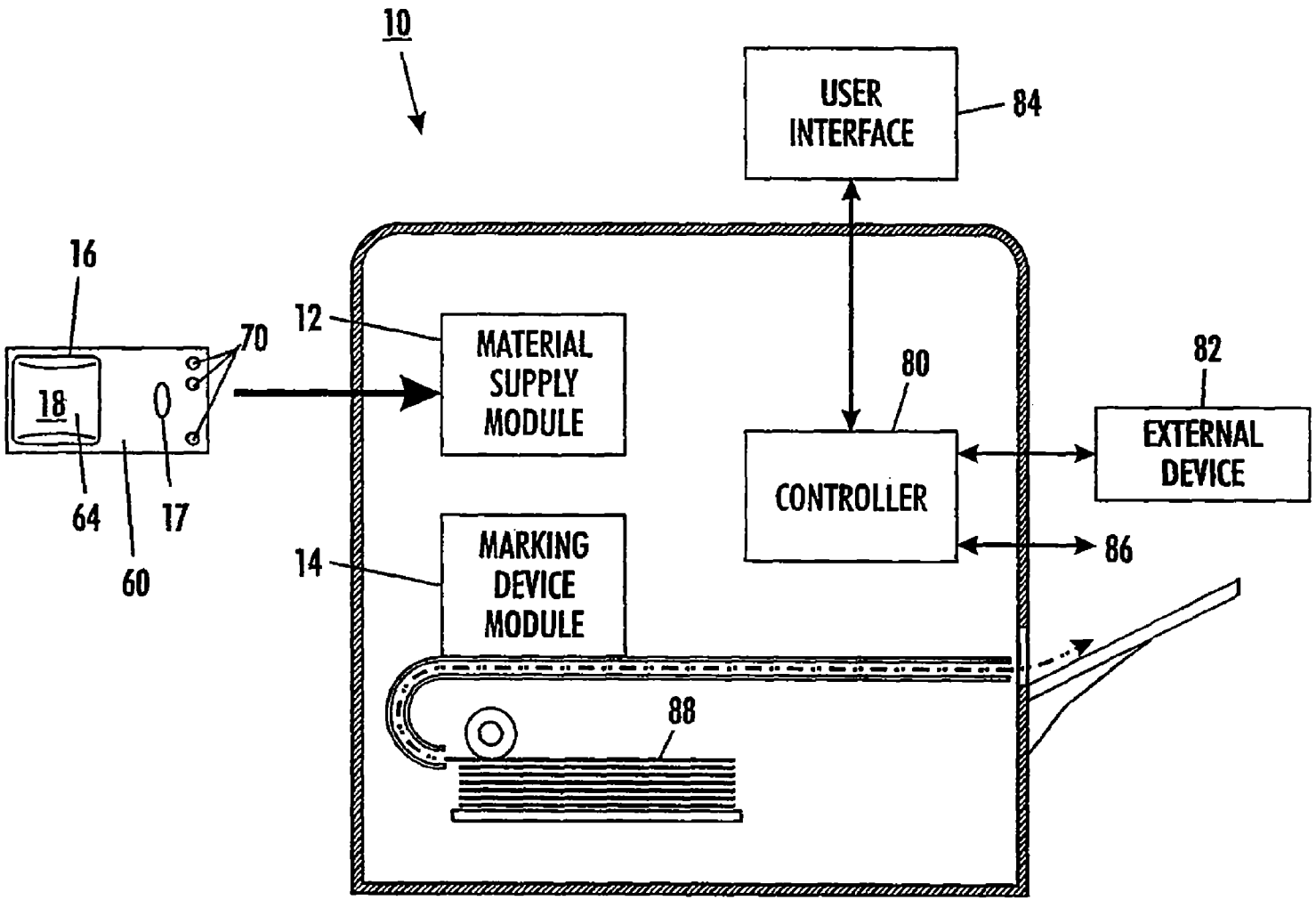
FIG. 1 is a machine including a material supply module according to one embodiment of the present application.

FIG. 1 is a schematic depiction of a machine 10 including replaceable modules 12 and 14, also known as "customer replaceable units" or CRUs. For purposes of discussion herein, machine 10 is depicted as a printing apparatus, such as a digital printer of the ink jet or "laser" (electrophotographic or xerographic) variety, or a digital or analog copier. Modules 12 and 14 are depicted as hardware devices related to printing, such as a marking material supply module and a marking device module, respectively. In the embodiment of FIG. 1, marking material supply module 12 is adapted to receive and collapse a package 16, which contains a predetermined amount of a material 18, e.g., a marking material such as a toner, ink, or similar. Package 16, which is generally collapsible, typically includes an information-bearing tag 17, which may identify material 18, the amount of material remaining in the package, or other information. Material 18 is supplied to marking device module 14. It is contemplated, however, that machine 10 may be any electrical, electronic, mechanical, electromechanical device configured to perform one or more functions, and that marking material supply module 12 may be any component, group of components, system, or subsystem of the machine and material 18 may include any material, e.g., marking materials such as solid and liquid toners and inks, non-marking materials, chemical pellets, etc. It is also contemplated that marking material supply module 12 may or may not be removable from machine 10.

Figure 2:
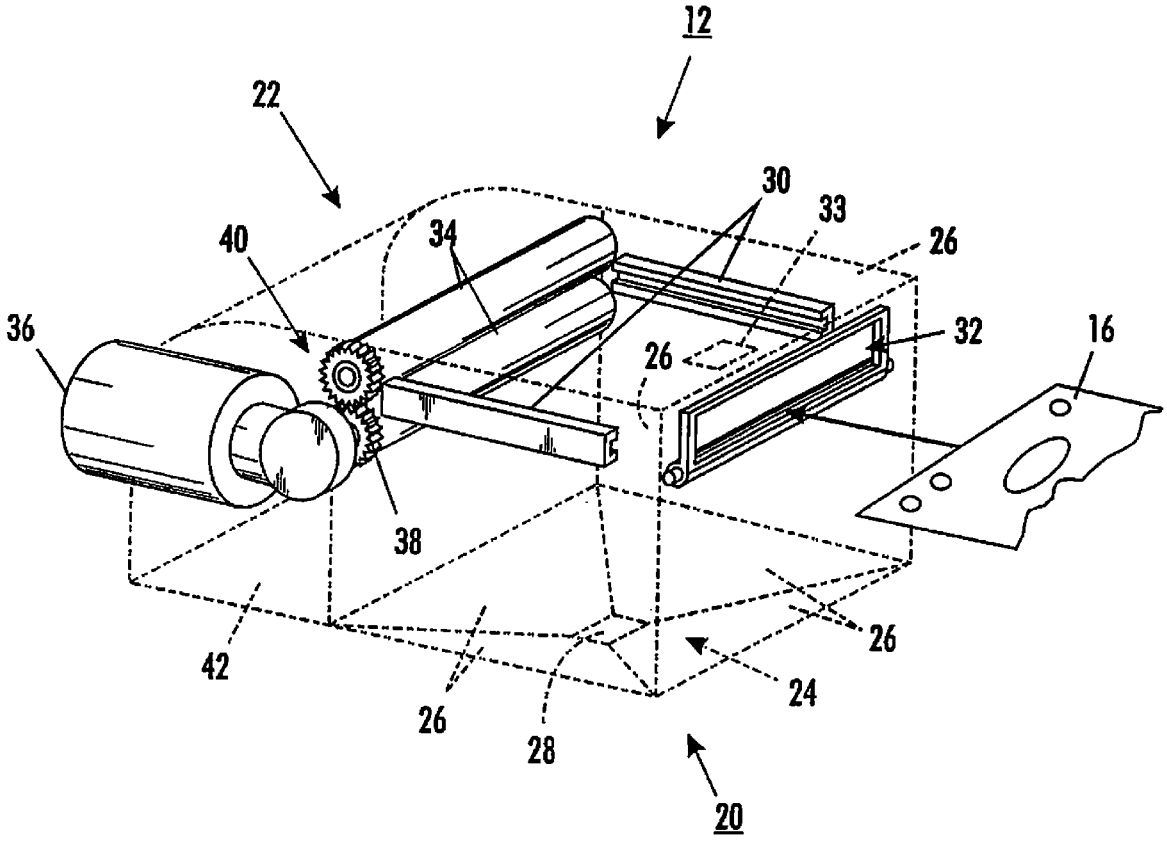
FIG. 2 is a material supply module according to one embodiment of the present application.

Referring now to FIG. 2, in one embodiment, marking material supply module 12 is generally self-contained and includes a hopper 20 and a package opening actuator 22, which is positioned within the hopper and configured to cause package 16 to open.

Hopper 20 includes an at least partially enclosed chamber 24 having a plurality of walls 26 and an opening 28. At least one of walls 26 is configured to facilitate movement of material 18 toward opening 28 when package 16 is situated in hopper 20. In one embodiment, one or more of walls 26 are angled so that material 18 gravity feeds toward opening 28. In other embodiments, walls 26 may include paddles, grooves, or other mechanical mechanisms to facilitate movement of material 18 toward opening 28. One or more of walls 26 may include a mechanism for guiding package 16 within hopper 20. In one embodiment, the mechanism includes one or more material package guide tracks 30, which are operatively connected with at least one of walls 26. In another embodiment, more than one mechanism may be included and more than one hopper 20 may be included. For example, a first mechanism may be used to direct black marking material to a first hopper and a second mechanism may be used to direct color marking material to a second hopper.

Opening 28 is typically a material outlet, which is defined in or adjacent to one or more of walls 26. In FIG. 2, opening 28 is defined in between four slanted or angled walls 26. In other embodiments, opening 28 may be an aperture defined within a single wall or an opening defined between any number of walls. For example, in an embodiment having a single wall (not shown), the single wall may be frusto-conically shaped to define a funnel with an opening. In addition to opening 28, a package inlet 32 may be defined in or adjacent to one or more of walls 26. Package inlet 32 may include a door/slot combination or any other configuration through which package 16 may be inserted into hopper 20. Although not included in FIG. 2, it is contemplated that more than one package inlet 32 may be included. For example, a first package inlet may be used to insert black marking material and a second package inlet may be used to insert color marking material. In one embodiment, a reader 33 may be positioned within marking material supply module 12 to read information-bearing tag 17. Typically, reader 33 is positioned in hopper 20 adjacent package inlet 32. Reader 33 is generally capable of reading tags using radio frequency identification (RFID) technology, bar coding, or any machine-readable coding. In some embodiments, reader 33 may also be capable of transmitting data to information-bearing tag 17.

In one embodiment, package opening actuator 22 may include two or more pressure rollers 34 configured to introduce pressure to package 16. Typically, a pressure roller drive motor 36 is included to drive pressure rollers 34. Typically, motor gears 38, which are joined with and driven by pressure roller drive motor 36, mesh with at least one of roller gears 40, which are joined with each of rollers 34 and engaged with one another, thereby driving pressure rollers 34. Pressure rollers 34 are typically configured to develop a pressure within package 16 sufficient to cause the package to collapse thereby causing material 18 contained with the package to deposit into hopper 20 or directly into opening 28. Package opening actuator 22 is not limited to pressure rollers 34 but may include any mechanical or thermal mechanisms, which successfully cause package 16 to open or collapse. In one embodiment, pressure rollers 34 may rotate in a direction sufficient to cause package 16 to be ejected from machine 10. For example, based on the information obtained by reader 33, it may be determined that the wrong marking material has been inserted and therefore package 16 should be rejected and ejected from machine 10 before it is collapsed or opened. Accordingly, pressure rollers 34 may be directed to rotated in a manner to cause package 16 to be ejected from machine 10 before it has been opened. In other embodiments not having pressure rollers 34, other mechanisms for ejecting package 16 may be utilized. In still other embodiments, machine 10 may include mechanisms for ejecting package 16 after it has been opened. For example, after an opened package 16 may exit pressure rollers 34 and be directed out of machine 10 through an additional opening (not shown) in hopper 20.

Marking material supply module 12 may also include a waste collection area 42, which is typically configured to receive and store each package 16 after material 18 is expelled. For example, after a period of use, waste collection area 42 may contain a plurality of opened packages 16. In some embodiments, waste collection area 42 may be accessible to allow for removal of waste packages 16. In other embodiments, waste collection area 42 may be inaccessible to a user of machine 10. In such an embodiment, waste packages 16 may remain in machine 10 for the life of the machine. In still other embodiments, waste collection area 42 may include mechanisms for disintegrating any packages contained therein, e.g., chemical, heat, or other systems.

Figure 3:
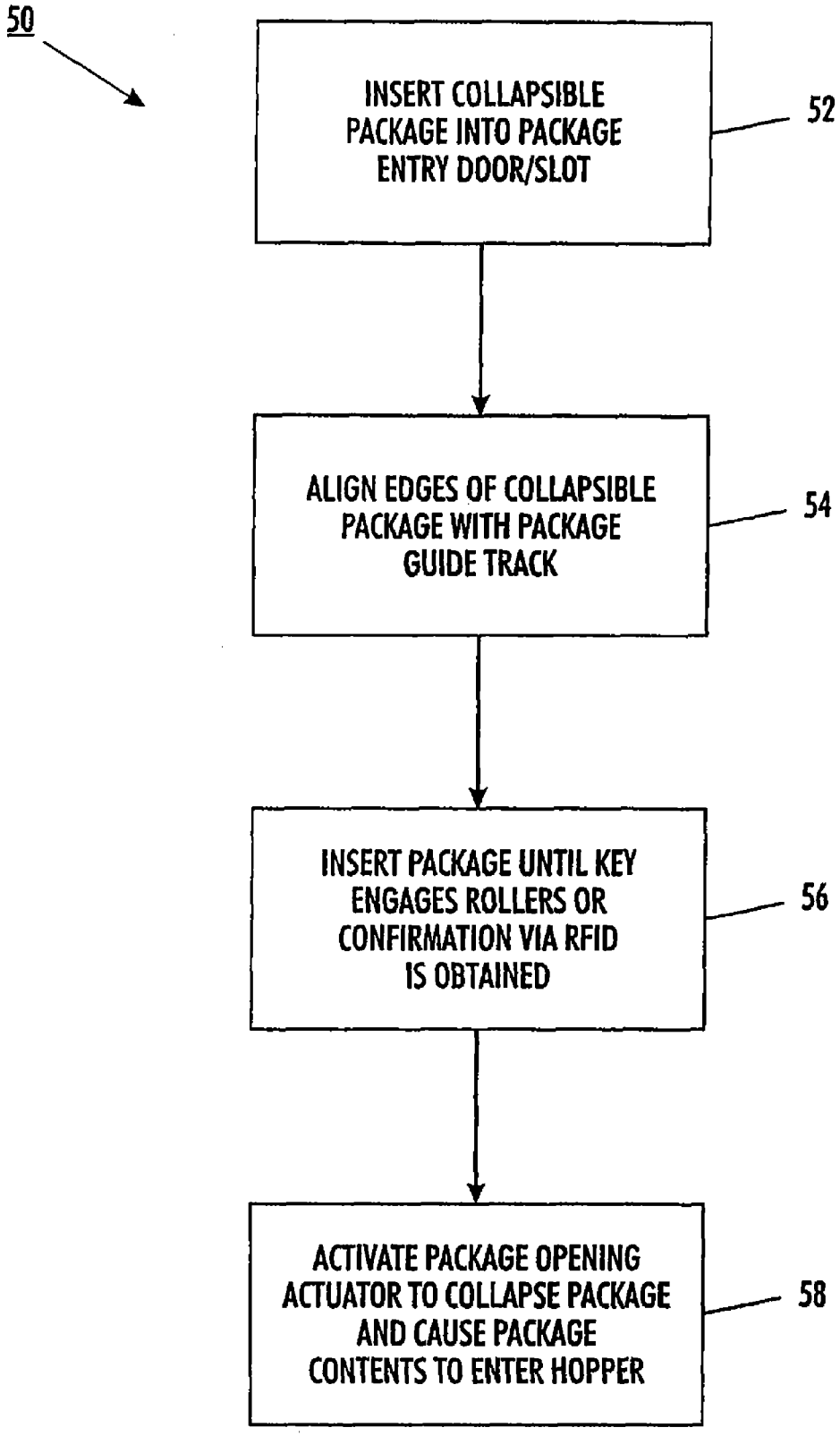
FIG. 3 is a flowchart of a method of supplying material contained in a collapsible package according to one embodiment of the present application.

Referring now to FIG. 3, another embodiment includes a method 50 of supplying material contained in a package. First at step 52, package 16, which includes information-bearing tag 17, is fed into a housing such as hopper 20. Next at step 54, edges of package 16 are typically aligned with guide tracks such as material package guide tracks 30 as package 16 is fed into hopper 20. Then, at step 56, the material such as material 18 is verified in package 16 without visually inspecting the collapsible package, e.g. reader 33 reads information-bearing tag 17. Next, at step 58, package 16 is collapsed while the collapsible package is at least partially within hopper 20 to expel material 18 from the collapsible package. Typically, package opening actuator 22 is used to open package 16. Generally, package inlet 32 is closed and sealed when package 16 is opened to prevent material 18 from exiting hopper 20. Finally, method 50 may include the additional step (not shown in FIG. 3) of storing each of package 16 after it has been collapsed or opened.

Figure 4:
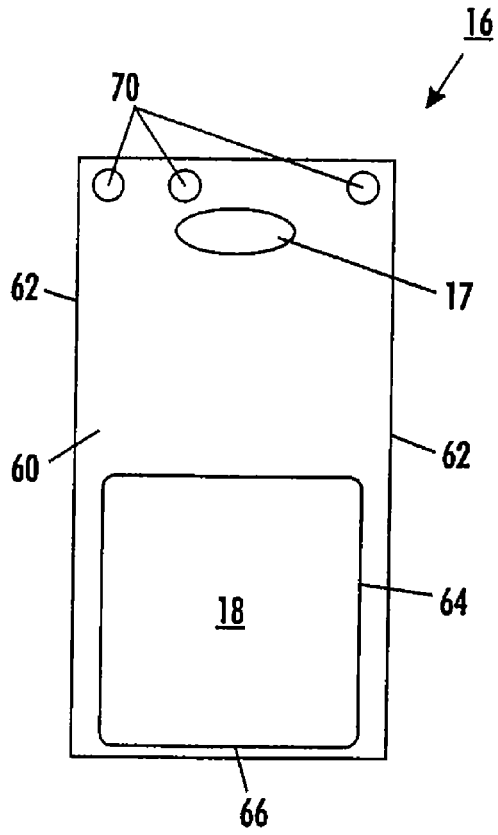
FIG. 4 is a top view of a collapsible package according to one embodiment of the present application.
Figure 5:
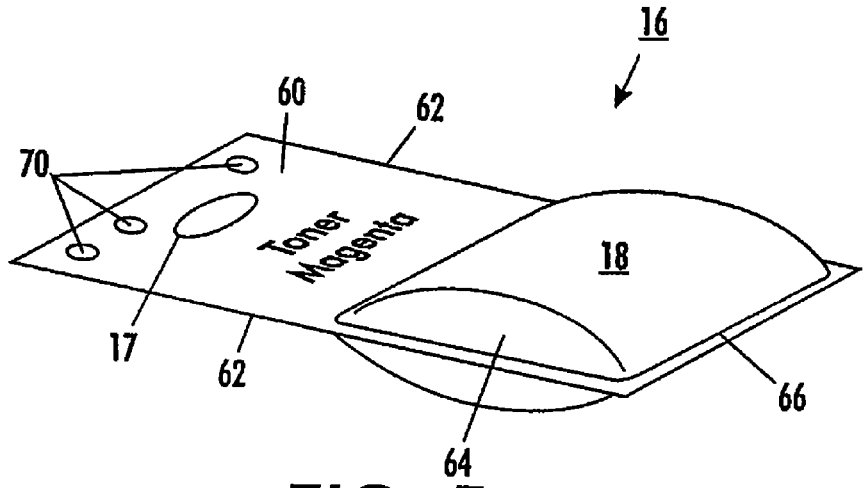
FIG. 5 is a is a side perspective view of the collapsible package in FIG. 4.

Referring now to FIGS. 4 and 5, package 16, which is suitable for use in material supply module 12, includes a package surface 60, which is adapted to engage one or more surfaces (not shown) of material supply module 12. Package surface 60 includes side edges 62, which may be adapted to engage material package guide tracks 30 of hopper 20. A material pouch 64, which may contain material 18, is joined with or formed in package surface 60. Material pouch 64 typically includes a burst line 66, which is adapted to burst when placed under a predetermined pressure, heated to a predetermined temperature, or mechanically penetrated. In one embodiment, material pouch 64 is adapted to be refilled with material, e.g., particulate solid ink, and burst line 66 is adapted to be resealed after it is burst, e.g., includes a "zip-lock", re-sealable adhesive portion, or similar enclosure. Typically, burst line 66 is a portion of material pouch 64 that has a lower tensile or puncture strength than other portions of the material pouch. Material pouch 64 is typically flexible and/or collapsible and generally has a substantially flat shape when fully collapsed. In one embodiment, material pouch 64 is light transmissive so that at least the color of the contents of the pouch may be viewed from the outside. Package 16 may also include a material identifier mechanism formed on package surface 60 or material pouch 64, e.g., information-bearing tag 17, one or more keys 70, or similar, for verifying the contents of collapsible material pouch 18. Information-bearing tag 17 may include radio frequency identification technology, a bar code, any machine-readable code, or any technology suitable for such an application. Keys 70 may be mechanical keys or optical keys. In embodiments including optical keys, reader 33 may be adapted to interact with the optical keys.

In use, machine 10 may include a controller 80, which generally controls the operation of the machine. When modules 12 and 14 are installed in machine 10, controller 80 communicates with the modules via data paths, which are indicated by double-ended arrows in FIG. 1. In addition, data may be communicated between a device 82 external to machine 10 and controller 80. Controller 80 may also communicate with users through a user interface 84 or through a network connection 86, such as over phone lines or the Internet.

In operation, sheets on which images are to be printed are drawn from a stack 88 and move relative to the marking device module 14, where the individual sheets are printed upon with desired images. The marking material for placing marks on various sheets by marking device module 14 is provided by marking material supply module 12. If machine 10 is an electrostatographic printer, marking material supply module 12 may include a supply of solid or liquid toner, while marking device module 14 includes any number of hardware items for the electrostatographic process, such as a photoreceptor or fusing device. In the well-known process of electrostatographic printing, the most common type of which is known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finally divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper from the stack 88, and the image affixed thereto to form a permanent record of the image.

In the ink-jet context, the marking material supply module 12 includes a quantity of liquid ink, and may include separate tanks for different primary-colored inks, while marking device module 14 includes a printhead. In either the electrostatographic or ink-jet context, "marking material" can include other consumed items used in printing but not precisely used for marking, such as oil or cleaning fluid used in a fusing device. Of course, depending on a particular design of a machine 10, the functions of modules 12 and 14 may be combined in a single module, or alternatively, the marking device may not be provided in an easily replaceable module such as 14. Further, there may be provided several different marking material supply modules 12, such as in a full color printer. In general, for purposes of the present embodiment, there may simply be provided one or more replaceable modules associated with machine 10, and it is expected that, at times within the life of machine 10, one or more of these modules need to be removed or replaced. In the current market for office equipment, for example, it is typically desirable that modules such as 12 and 14 be readily replaceable by the end user, thus saving the expense of having a representative of the vendor visit the user.

Figure 6:
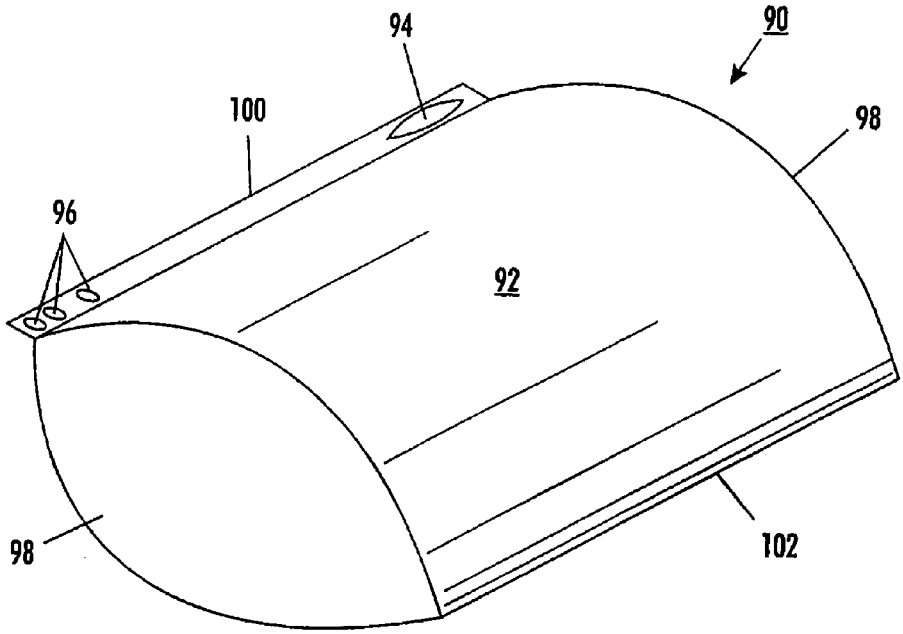
FIG. 6 is a front perspective view of a collapsible package according to one embodiment of the present application.
Figure 7:
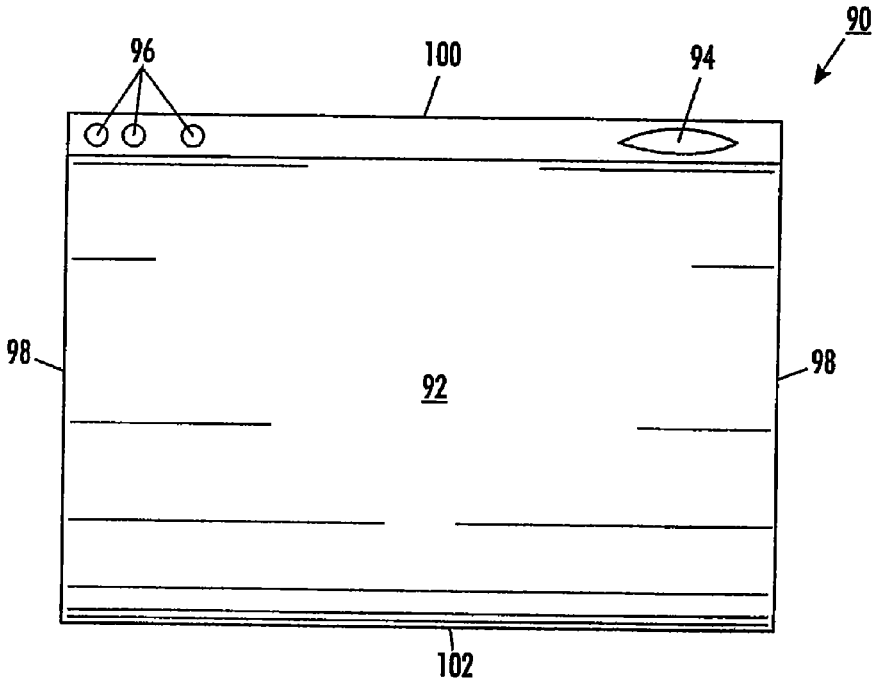
FIG. 7 is a top view of the collapsible package in FIG. 6.

Referring now to FIGS. 6 and 7, in an alternative embodiment, a collapsible package 90, which is suitable for use in material supply module 12, includes a package surface 60. Collapsible package 90 includes a collapsible material pouch 92 and a material identifier mechanism such as a radio frequency identification tag 94, one-or more keys 96, or similar, for verifying the contents of the collapsible material pouch while the pouch is at least partially inserted in the material supply module. Collapsible material pouch 92 includes side edges 98 and a top edge 100, which may be adapted to engage material package guide tracks 30 of hopper 20. Collapsible material pouch 92 typically includes a burst line 102, which is adapted to burst when placed under a predetermined pressure, heated to a predetermined temperature, or mechanically penetrated.

Figure 8:
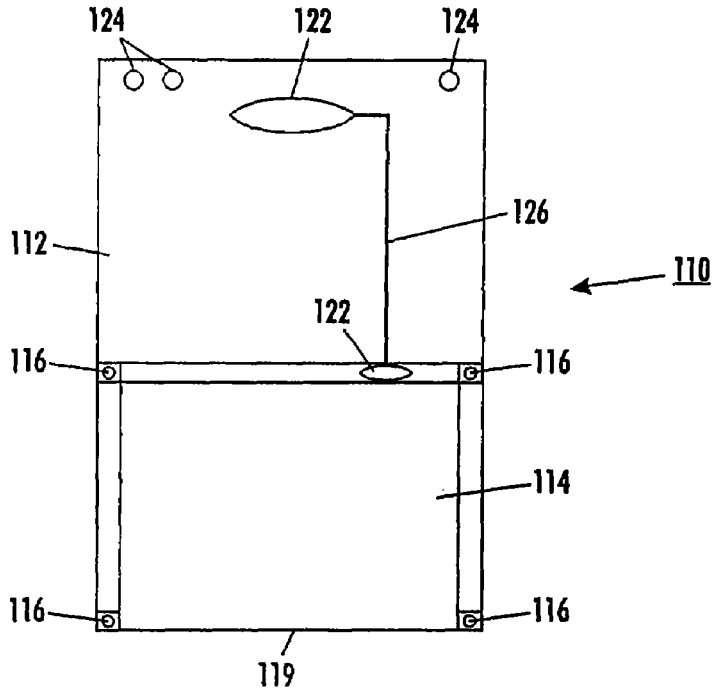
FIG. 8 is a top view of a collapsible package having a reusable carrier joined with a collapsible material pouch according to one embodiment of the present application.
Figure 9:
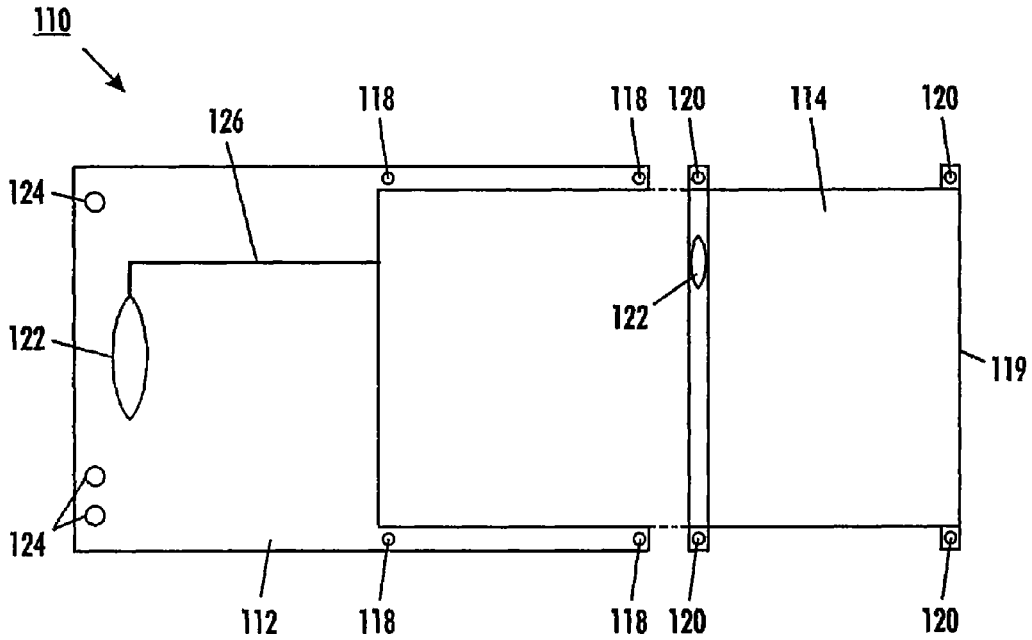
FIG. 9 is an exploded view of the collapsible package in FIG. 8.

Referring now to FIGS. 8 and 9, in another alternative embodiment, a collapsible package 110, which is suitable for use in material supply module 12, includes a reusable carrier 112 and a collapsible material pouch 114 joined with the carrier. Reusable carrier 112 and collapsible material pouch 114 may be joined using a snap-fit connection 116, which includes indents 118 formed in the reusable carrier that releasably connect with detents 120 formed in the collapsible material pouch. Of course, any other types of connections known in the art or otherwise, which permit collapsible material pouch 114 to be releasably connected with reusable carrier 112, may be used. Reusable carrier 112 is typically adapted to engage one or more surfaces of material supply module 12 to facilitate loading of collapsible package 110 into the module. Reusable carrier 112 is typically fabricated from plastic but may also be fabricated from paper, cardboard, or any other reusable durable material. Collapsible material pouch 114 is typically fabricated from plastic or foil, but may be fabricated from any lightweight collapsible material. Collapsible material pouch includes a burst line 119. Collapsible material pouch 114 is typically discarded after burst line 119 is broken and the pouch is collapsed. However, in at least one embodiment, burst line 119 may be resealed and collapsible material pouch 114 may be refilled and reused. Collapsible reusable carrier 112 and collapsible material pouch 114 may include a material identifier mechanism such as a radio frequency identification tag 122, one or more keys 124, or similar, for verifying the contents of the collapsible material pouch. In one embodiment, radio frequency identification tag 122 on reusable carrier 112 may be joined with the radio frequency identification tag or other data source on collapsible material pouch 114 via a wire 126 or similar electrical connection for communicating data. In such an embodiment, for each different type of material, collapsible material pouch 114 may include a different identifying code, which is transmitted to radio frequency identification tag 122 on reusable carrier 112 via wire 126. In use, collapsible package 110 may be refilled by first providing reusable carrier 112 and then joining an un-collapsed collapsible material pouch 114 with the carrier.

Referring again to FIGS. 6 and 7, another embodiment includes a method of remanufacturing a package 90 suitable for containing marking material used in a printing machine 10. First, an at least partially empty material pouch 92 is provided. Material pouch 92 is adapted to engage one or more surfaces of printing machine 10 and includes both an unsealed burst line 102 and an information-bearing tag 94 for verifying its contents. Next, material pouch 92 is at least partially filled with marking material. Then, burst line 102 is sealed. An additional step may include altering data associated with information-bearing tag 94.

Still referring to FIGS. 6 and 7, another embodiment includes a method of remanufacturing a package 90 suitable for containing marking material used in a printing machine. The method includes the first step of providing an at least partially empty material pouch 92, which includes an information-bearing tag 94 for verifying the contents of the material pouch. Next, information-bearing tag 94 is removed. Then, a replacement material pouch (not shown) that is substantially full of marking material is provided. Finally, information-bearing tag 94 is attached to the replacement material pouch. An additional step may include altering data associated with information-bearing tag 94.

Now again referring to FIGS. 8 and 9, another embodiment includes a method of remanufacturing a package 110 suitable for containing marking material used in a printing machine. The method includes the first step of providing a carrier 112, which is adapted to engage one or more surfaces of printing machine 10. Next, a material pouch 114 containing marking material is joined with carrier 112.

Still referring to FIGS. 8 and 9, another embodiment includes a method of remanufacturing a package 110 suitable for containing particulate solid ink used in a printing machine 10. The method includes the first step of providing a material pouch 114 that is at least partially empty of particulate solid ink. Material pouch 114 includes an unsealed burst line 119 and an information-bearing tag 122 for verifying the contents of the material pouch. Next, material pouch 114 is at least partially filled with particulate solid ink. Then, burst line 119 is sealed. Next, a carrier 112, which is adapted to engage one or more surfaces of printing machine 10, is provided. Finally, material pouch 114 is joined with carrier 112.

It should be understood that any of the features, characteristics, alternatives, or modifications described regarding a particular embodiment herein may also be applied, used, or incorporated with any other embodiment described herein.

A number of embodiments have been described. Nevertheless, it will be understood that various modifications may be made without departing from the spirit and scope of the invention. Accordingly, other embodiments are within the scope of the following claims.

What is claimed is:

1. A method of remanufacturing a package suitable for containing marking material used in a printing machine for placing marks on an object, the method comprising:

providing a material pouch that is adapted to engage one or more surfaces of the printing machine, said material pouch including a resealable burst line extending parallel to an edge thereof and an information-bearing tag for verifying the contents of said material pouch, the burst line having a lower tensile strength than other portions of the material pouch or a lower puncture strength than other portions of the material pouch;

feeding the package into the printing machine along a first path including a package inlet;

at least partially emptying the contents of said material pouch by collapsing the material pouch causing unsealing of the burst line;

at least partially refilling said material pouch with marking material; and subsequently resealing said burst line, so that the material pouch provided in said providing step and the material pouch of the remanufactured package are the same, and wherein a second path is provided for the object to move relative to the printing machine, the second path being different from the first path and not including the package inlet.

2. A method of remanufacturing according to claim 1, further comprising:

altering data associated with said information-bearing tag.

3. A method of remanufacturing a package suitable for containing marking material used in a printing machine for placing marks on an object, the method comprising:

first providing a material pouch including a resealable burst line extending parallel to an edge of the pouch, the burst line having a lower tensile strength than other portions of the material pouch or a lower puncture strength than other portions of the material pouch, and an information-bearing tag for verifying the contents of said material pouch;

feeding the package into the printing machine along a first path including a package inlet;

at least partially emptying the contents of said material pouch by collapsing the material pouch causing unsealing of the burst line;

removing said information-bearing tag from said at least partially empty material pouch;

subsequently providing a replacement material pouch that is substantially full of marking material; and attaching said information-bearing tag to said replacement material pouch, wherein a second path is provided for the object to move relative to the printing machine, the second path being different from the first path and not including the package inlet.

4. A method of remanufacturing according to claim 3, further comprising:

altering data associated with said information-bearing tag.

5. A method according to claim 3, wherein said step of providing a replacement material pouch further comprises:

at least partially refilling said at least partially empty material pouch with marking material; and subsequently resealing said burst line to form the replacement material pouch, so that the material pouch provided in said first providing step and the material pouch of the remanufactured package are the same.

6. A method of remanufacturing a package suitable for containing marking material used in a printing machine, the method comprising:

providing a reusable carrier adapted to engage one or more surfaces of the printing machine; and joining a material pouch, which contains marking material and has a resealable burst line extending parallel to an edge of the pouch, with said carrier by releasably connecting the pouch and the carrier so that the burst line extends along an edge portion of the carrier, wherein the burst line has a lower tensile strength than other portions of the material pouch or a lower puncture strength than other portions of the material pouch;

feeding the package into the printing machine to engage the material pouch with at least one of said surfaces of the printing machine;

at least partially emptying said material pouch by collapsing the material pouch due to engaging the material pouch with said at least one of said surfaces, causing unsealing of the burst line; and subsequently joining another material pouch containing marking material with the carrier.

7. A method according to claim 6, further comprising:

subsequent to collapsing the material pouch, at least partially refilling said material pouch with marking material; and subsequently resealing said burst line so that the material pouch joined in said first joining step and the material pouch of the remanufactured package are the same.

8. A method of remanufacturing a package suitable for containing particulate solid ink used in a printing machine, the method comprising:

first providing a material pouch including a resealable burst line extending parallel to an edge thereof and an information-bearing tag for verifying the contents of said material pouch, said burst line having a lower tensile strength than other portions of the material pouch or a lower puncture strength than other portions of the material pouch;

feeding the package into the printing machine to engage the material pouch with one or more surfaces of the printing machine;

at least partially emptying the contents of said material pouch by collapsing the material pouch due to engaging the material pouch with at least one of said one or more surfaces, causing unsealing of the burst line;

at least partially refilling said material pouch with particulate solid ink;

subsequently resealing said burst line;

providing a carrier adapted to engage one or more surfaces of the printing machine; and joining said material pouch with said carrier, so that the material pouch provided in said first providing step and the material pouch of the remanufactured package are the same.

* * * * *